US007459676B2

(12) United States Patent
Kovtoun

(10) Patent No.: US 7,459,676 B2
(45) Date of Patent: Dec. 2, 2008

(54) MALDI/LDI SOURCE

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 505 days.

(21) Appl. No.: 11/284,487

(22) Filed: Nov. 21, 2005

(65) Prior Publication Data

US 2007/0114437 A1 May 24, 2007

(51) Int. Cl.
*H01T 23/00* (2006.01)
*H01J 49/10* (2006.01)

(52) U.S. Cl. ..... 250/288; 250/423 R; 250/396 R; 250/281; 250/423 P; 250/282

(58) Field of Classification Search ..... 250/423 P, 250/423 F, 423 R, 396 R, 397, 398, 399, 250/400, 288, 281, 282
See application file for complete search history.

(56) References Cited

U.S. PATENT DOCUMENTS 4,720,633 A 1/1988 Nelson
5,118,937 A * 6/1992 Hillenkamp et al. ..... 250/282
5,663,561 A * 9/1997 Franzen et al. ..... 250/288
6,110,291 A * 8/2000 Haruta et al. ..... 118/726
6,646,261 B2 11/2003 Krans
6,680,477 B2 * 1/2004 Beck et al. ..... 250/288
7,064,318 B2 * 6/2006 Bui ..... 250/282
7,161,159 B2 1/2007 Hill et al.
7,180,058 B1 * 2/2007 Izgarian ..... 250/288
2002/0011560 A1 * 1/2002 Sheehan et al. ..... 250/283
2004/0245453 A1 * 12/2004 Izgarian et al. ..... 250/288
2006/0186332 A1 * 8/2006 Haase et al. ..... 250/288

OTHER PUBLICATIONS

Spengler et al., "Scanning Microprobe Matrix-Assisted Laser Desorption Ionizion (SMALDI) Mass Spectrometry: Instrumentation for Sub-Micrometer Resolved LDI and MALDI Surface Analysis," J. Am. Soc. Mass Spectrom., Elsevier Sciences Inc., p. 735-748, (2002).
Piyadasa et al., "Imaging MALDI with an Orthogonal TOF Mass Spectrometer," 52nd ASMS Conference on Mass Spec and Allied Topics, (2004).

(Continued)

*Primary Examiner*—Jack I Berman
*Assistant Examiner*—Michael J Logie
(74) *Attorney, Agent, or Firm*—Sharon Upham; Charles B. Katz

(57) ABSTRACT

A MALDI/LDI source includes an ion collection device, e.g., a skimmer, orifice, mass analyzer, ion transfer optics and/or ion guide, configured for use with a short focal length lens with a large aperture. In some embodiments, the ion collection device includes an outer edge that can be disposed approximately parallel to a beam envelope between a lens and a focal point positioned at a MALDI/LDI sample. This configuration of the outer edge allows the ion collection device to be placed in close proximity to the focal point. This placement results in favorable collection efficiencies of laser desorbed analyte from the MALDI/LDI sample.

18 Claims, 7 Drawing Sheets

OTHER PUBLICATIONS

Bouschen et al., "Automated 3D-SMALDI imaging with a lateral resolution of 1um," Inst. Inorganic and Analytical Chem., (2003).
Luxembourg et al., "High Spatial Resolution Mass Spectrometric Imaging of Peptide and Protein Distributions on a Surface," Analytical Chemistry, vol. 76 ( No. 18), p. 5339-5344, (2004).
Bouschen et al, "SMALDI Imaging at 1 um Lateral Resolution," 52nd ASMS Conference on Mass Spectrom and Allied Topics, (2004).
Ens et al, "Abstract—Molecular Imaging using an Orthogonal-Injection Time-of-Flight Mass Spectrometer with a Matrix-Assisted Laser Desorption Ionization Source," (2004).
Chaurand et al., "MALDI-MS Imaging of Tissue Sections with a Resolution of 10 microns," Vanderbuilt Univ., (2002).
Schriver et al., "High Resolution Imaging Mass Spectrometry: Characterization of Ion Yields and Laser Spot Sizes," Vanderbilt Univ., (2003).

* cited by examiner

MALDI/LDI SOURCE

BACKGROUND

1. Field of the Invention

The invention is in the field of mass spectrometry and more specifically in the field of ionization sources in mass spectrometry.

2. Related Art

Laser-based ionization techniques, which include laser desorption/ionization (LDI) and matrix-assisted laser desorption/ionization (MALDI), are useful tools for mass spectrometric analysis. These techniques involve irradiating a sample containing an analyte substance with a short pulse of radiation, typically emitted by a laser. The radiation is absorbed by the sample, resulting in the desorption and ionization of analyte molecules from the sample. In the MALDI process, the sample is prepared by diluting small amounts of the analyte substance in a large molar excess of matrix material, which is highly absorbent at the irradiation wavelength and which assists in the desorption and ionization of the analyte molecules. MALDI is a particularly useful technique for the analysis of large biological molecules, such as peptides or proteins that may undergo fragmentation when subjected to alternative ionization methods. Furthermore, MALDI tends to produce singly-charged ions, thereby facilitating interpretation of the resultant mass spectra. The ions produced by the LDI or MALDI source (or product ions derived therefrom) may be analyzed using any one or combination of mass analyzers known in the art, including quadrupole mass filters, quadrupole ion traps, time-of-flight analyzers, Fourier transform ion cyclotron resonance cells, and electrostatic traps.

Recently, there has been growing interest in the use of LDI/MALDI mass spectrometry to generate spatially resolved maps of analyte concentrations in a biological material, such as a tissue sample. This process, which is often referred to as mass spectral tissue imaging, offers great promise as a tool for the study of drug absorption and excretion by selected tissues. Because analyte concentrations in a tissue sample may exhibit large spatial gradients, it is generally desirable to perform tissue imaging experiments at high spatial resolution in order to gain useful information regarding analyte concentration profiles at areas of interest within the sample.

The minimum spatial resolution that can be obtained using a MALDI or LDI source will be partially determined by the spot size, i.e., the area of the sample that is irradiated by the laser or other irradiation source. In most commercially available MALDI sources, the spot size has a diameter of around 100 μm, which is too large for many tissue imaging applications. The spot size may be reduced by more tightly focusing the radiation beam at the sample surface, e.g., by using a beam-focusing lens having a shorter focal length with a large aperture. However, the presence and positioning in the ionization source chamber of the ion guide or other optics, which transport the ions from the sample location to the mass analyzer, will often interfere with the placement of a short focal length lens, thereby making it difficult or impossible to focus the beam to the desired size. The placement of a short focal length lens may also be rendered more difficult by the presence of viewing optics employed to acquire an image of the sample.

In addition to the above it can be desirable to position a collection device as close as possible to the point of sample desorption, or at least as close as possible to the direction of flight of the ions. The desire to bring both the collection device and the lens as close as possible to the MALDI sample creates a conflict because there is limited room near the MALDI sample.

One approach to reducing this conflict is to use a lens or other optic having an opening configured for ions to pass through. Such systems work well when the ions are well collimated into a beam, and an ion collection device or the mass analyzer itself can be positioned in line with the path of the laser beam. This approach is most satisfactory where ions are extracted from the source region with a high electric field, thus preventing ions from dispersing before they reach the optic opening. Ions in these systems, typically go from a region of high potential/electric field to the substantially vacuum region of the mass analyzer itself.

In systems without strong extraction fields, e.g., ion traps, quadrupoles, ICR cells, etc., the use of an optic with an opening can be very inefficient because the ions have a greater chance to disperse before reaching the opening. To accommodate such systems, in some MALDI systems ions are generated from a MALDI sample and then collected by a skimmer or other ion collection device for transport to a mass spectrometer. In these systems high pressure in front of skimmer enables the ions that have been dispersed not to dissociate and be efficiently collected by providing the pressure differential between the skimmer and the region prior to the skimmer. In view of the above discussion, there is a need in the art for an LDI or MALDI source that prevents dispersion, and provides for high efficiency of ion collection in tissue imaging or other applications that require the use of systems without strong extraction fields.

SUMMARY

The invention includes one or more ion collection devices configured for use in a MALDI/LDI source having a short focal length lens. The ion collection device is configured to collect desorbed analyte from the MALDI/LDI sample, and is shaped to match a desorption/optical beam shape resulting from the short focal length. In some embodiments, the ion collection device is shaped also to match a desorption/optical beam shape resulting from the large numerical aperture lens. The match between the beam profile and the shape and/ore orientation of the ion collection device allows the ion collection device to be placed in a desirable proximity to a MALDI/LDI sample during desorption. This desirable proximity may result in a desirable collection efficiency of desorbed analyte.

Some embodiments of the invention include a plurality of replaceable ion collection devices each matched for use with beam focusing optics of a different focal length. When beam focusing optics are changed, for example to alter the resolution in spatially resolved MALDI/LDI, the replaceable ion collection device can also be replaced.

Various embodiments of the invention include a system comprising a sample support configured to support a MALDI/LDI sample on a first surface, first beam focusing optics configured to direct a first radiation along a beam envelope to a focal point on the MALDI/LDI sample, and having a focal length of less than 20 millimeters, the first beam focusing optics being disposed approximately parallel to the first surface, a first ion collection device configured to collect ions generated from the MALDI/LDI sample using the directed radiation, the first ion collection device having a first outer edge approximately parallel to the beam envelope along which the first radiation is directed by the first beam focusing optics, and being disposed less than 10 millimeters from the focal point, and a mass analyzer configured to determine mass-to-charge ratios of the collected ions.

Various embodiments of the invention include a system comprising beam focusing optics having a large numerical aperture, that is in a numerical aperture between 0.5 and 1.0.

Various embodiments of the invention include a method comprising desorbing part of a MALDI/LDI sample using a first radiation with a spatial resolution of less than 8 micrometers, collecting ions from the desorbed part of the MALDI/LDI sample using an ion collection device disposed less than 10 millimeters from the MALDI/LDI sample, and transferring ions to the mass analyzer to determine mass-to-charge ratios of the collected ions using a mass analyzer.

Various embodiments of the invention include a system comprising a sample support configured to support a MALDI/LDI sample on a first surface, means for desorbing the MALDI/LDI sample with a spatial resolution of less than 8 micrometers means for collecting ions from the desorbed MALDI/LDI sample using an ion collection device disposed less than 15 millimeters from the MALDI/LDI sample and means for transferring ions to a mass analyzer to determine the mass-to-charge ratios of the collected ions.

DETAILED DESCRIPTION

The invention includes a MALDI/LDI source in which beam focusing optics is configured to focus light to a focal point at a MALDI/LDI sample and an ion collection device configured to collect ions and/or neutrals resulting from the MALDI sample. The size of the focal point is dependent, in part, on the focal length of the lens. Generally, smaller focal lengths result in smaller focal points. Thus, in applications where spatial resolution of the focal point at the MALDI/LDI sample is important, it can be desirable to use a short focal length lens rather than a longer focal length lens. It can also be desirable to use a lens of large numerical aperture rather than a smaller numerical aperture lens. The ion collection efficiency of the ion collection device is dependent, in part, on the distance between the focal point and the ion collection device. Generally, the closer the ion collection device to the focal point, the better the collection efficiency. The ion collection efficiency also depends, in part, on the angular distribution of velocities of the desorbing ions. The ions whose velocities deviate significantly from the center axis of ion transfer optics may be lost or additional means may be required to direct ions to that axis. An increase in the numerical aperture of the lens can improve optical quality, i.e. provide for a smaller spot size. However, a large numerical aperture lens will also structurally necessitate that the central axis of the collection device is at an angle that is further away from the central axis of the lens, that is, the axis about which most desorbed ions velocities are aligned. Thus a compromise has to be achieved to optimize these two features, the focal length and the numerical aperture.

In the invention, an ion collection device is configured to be positioned close to a focal point in order to achieve desirable collection efficiency. The ion collection device is configured to be positioned as close as possible to the direction of flight of the ions. The close position is achieved by shaping and/or orientating the ion collection device for use with beam focusing optics of a particular focal length or range of focal lengths. For example, in some embodiments the ion collection device includes a shape for use with a 10 mm focal length lens, and in some embodiments the ion collection device includes a shape for use with a 15 mm focal length lens. Some embodiments include beam focusing optics which comprises a plurality of exchangeable lenses, each of the plurality of exchangeable lenses matched to a different exchangeable ion collection device.

FIGS. 1-4 illustrate different embodiments of an LDI/MALDI source having various arrangements of the ion collection device. In each of these embodiments, the arrangement optionally includes short focal length beam focusing optics that generates a compact beam spot on the sample.

Figure 1A:
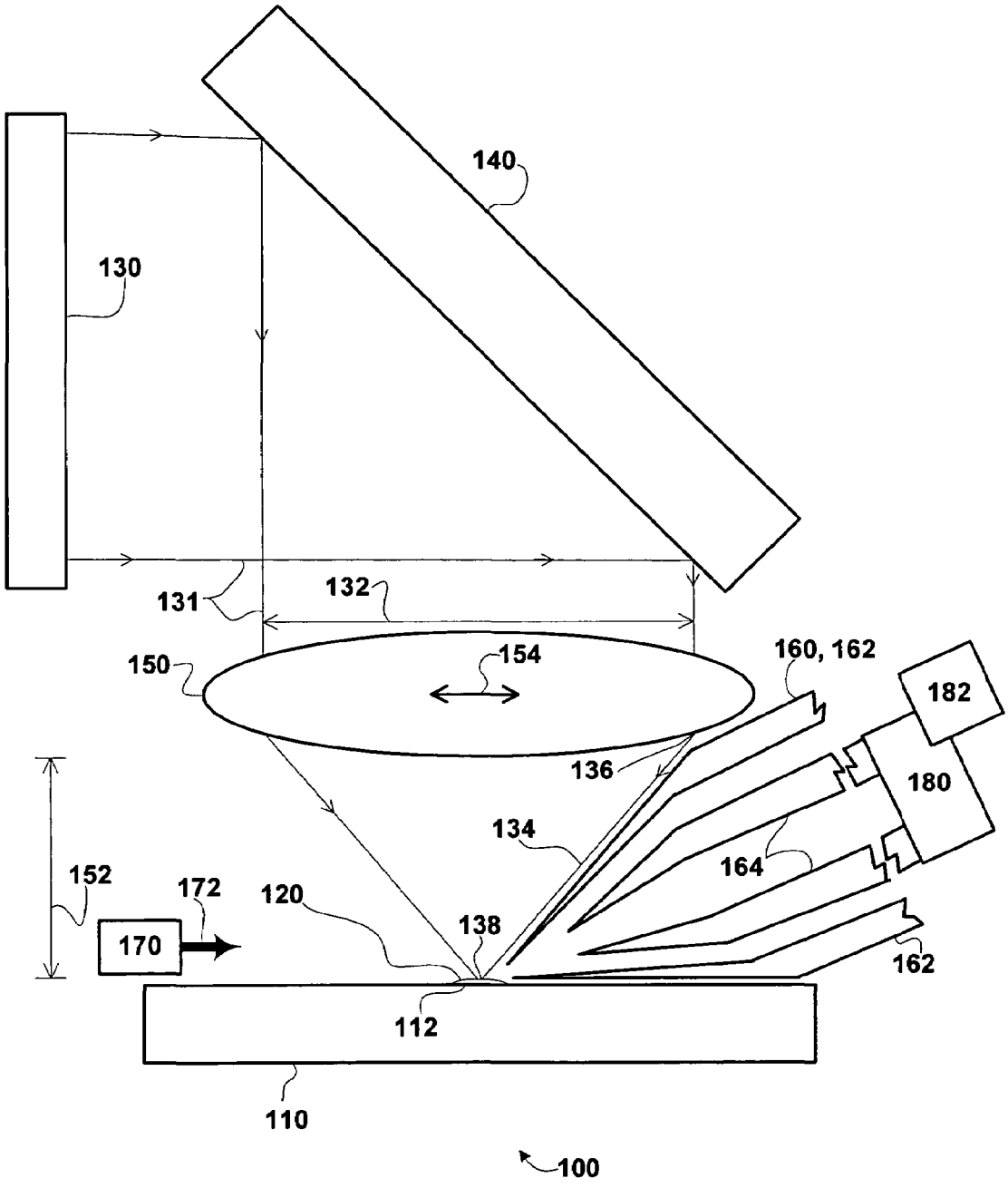
FIGS. 1A and 1B are an illustration of a MALDI/LDI source, according to various embodiments of the invention.

FIG. 1A is an illustration of a LDI/MALDI Source, generally designated 100. LDI/MALDI Source 100 accommodates a sample support 110 configured to hold a LDI/MALDI sample 120. Sample support 110 includes a sample support surface 112, on which one or more samples are deposited; this sample support surface 112 may be flat and hence lie in a plane. The surface may be flat and featureless, or may optionally include a conductive coating for application of an offset voltage, one or more chemical reagents configured to react with the analyte, and/or indentations configured to receive and hold the sample. Alternatively, the sample support surface 112 may be curved. LDI/MALDI sample 120 typically includes an analyte and an optional matrix configured to adsorb light. Such matrixes are well known in the art.

In some embodiments, LDI/MALDI source 100 further includes a radiation source 130 configured to generate radiation 131. Radiation source 130 is typically a laser. The radiation source 130 may take the form of a nitrogen or solid-state laser capable of emitting short pulses of radiation at a wavelength or wavelengths that are strongly absorbed by the sample. In some embodiments, radiation source 130 includes a plurality of lasers, a variety of beam steering optics, beam splitters, and the like. The radiation 131 is directed, using optional optics 140, to beam focusing optics 150. Beam-focusing optics 150 will typically include at least one lens that focuses a beam of radiation 131, which may be supplied by the radiation source 130, onto a sample disposed on or near the sample support surface 112 of the sample support 110. It is noted that beam-focusing optics 150 may, without limitation, consist of a single lens, as depicted in the figures. On arrival at the beam focusing optics 150, radiation 131 is characterized by a dimension 132. Dimension 132 will typically be a diameter, width, length or similar dimension.

Beam focusing optics 150 is configured to focus the radiation 131 along a beam envelope 134. Beam envelope 134 extends from a first point 136 where the radiation 131 exits the beam focusing optics 150 to a focal point 138. In some embodiments, beam envelope 134 is cylindrically symmetric around an axis from focal point 138 to a center of beam focusing optics 150. Focal point 138 is typically disposed at (e.g., on or within) the MALDI sample 120. In various embodiments, beam focusing optics 150 is configured such that focal point 138 is less than 5 micrometers, 3 micrometers, 2 micrometers, 1 micrometer, or 0.7 micrometers, in width or diameter.

Beam focusing optics 150 may also be configured to have a large numerical aperture. The numerical aperture of the beam focusing lens 150 is defined to be the sine of the angle, θ, that the marginal ray (the ray that exits the beam focusing lens 150 at its outer edge) makes with the optical axis multiplied by the index of refraction (n) of the medium. The numerical aperture can be defined for any ray as the sine of the angle made by that ray with the optical axis multiplied by the index of refraction: $NA=n\sin\theta$. For the purposes of this invention, a large numerical aperture is considered to be greater than 0.5, for example 0.8, 0.9 or greater.

Beam focusing optics 150, optional optics 140 and radiation source 130 are typically only part of the optical system associated with MALDI source 100. For example, MALDI source 100 may further include a CCD camera, steering optics, a photo multiplier tube, photodiode, beam splitters, or other such elements. In some applications, such as tissue imaging, it is desirable to include optical elements configured for viewing the position of focal point 138 on the sample. This is typically accomplished through the use of a CCD camera and associated optics. Thus, the optical system can be significantly larger and more complex than that shown in FIG. 1A. Without limitation optional optics 140 or other optical elements can be a dichroic mirror separating optical paths of beam irradiating the sample and causing desorption and the beam used for viewing the sample.

The width or diameter of focal point 138 is dependent on a focal length 152 of beam focusing optics 150, the wavelength of radiation 131, the size of the dimension 132, the distance between beam focusing optics 150 and sample support surface 112, and the orientation of beam focusing optics 150 relative to sample support surface 112. Focal length 152 of beam focusing optics 150 is a function of wavelength and is defined herein as the shortest distance between the principal plane or axis 154 of focusing optics 150 and focal point 138 (assuming the radiation is collimated when it reaches beam focusing optics 150). Focal point 138 of a minimum size is achieved when the distance between beam focusing optics 150 and MALDI sample 120 is approximately equal to focal length 152, and when beam focusing optics 150 is orientated such that a principal axis 154 is parallel to sample support surface 112.

An ion collection device 160, e.g., a skimmer, orifice, mass analyzer, ion transfer optics and/or ion guide, for example, is shown in cross-section in FIG. 1A and is optionally cylindrically symmetric around a central axis (not illustrated). In some embodiments, the ion collection device 160 may provide a means for collecting ions, in other embodiments, the ion collection device 160 may in addition serve to hold the ions it has collected. In an embodiment of the invention, ion collection device 160 includes an outer cone 162 and an optional inner cone 164. The region between outer cone 162 and inner cone 164 is optionally differentially pumped. Differential pumping serves to initiate the MALDI event at a higher pressure thus providing softer ionization conditions. This is known to be beneficial for tissue compounds that fragment easily, like phospholipids. Differential pumping also serves to generate a gas stream that guides ions into the ion transfer optics. Outer cone 162 is configured to collect analyte desorbed from MALDI/LDI sample 120 at focal point 138 by the radiation 131. The positioning of the entry orifice of an ion collection device 160 in close proximity to the sample surface and utilizing the closest possible angular match of velocities of desorbing ions with the axis of the ion collection device 160 improves ion collection efficiency. In the example illustrated in FIGS. 1A and 1B ions leave the surface at velocities close to an angle that is orthogonal to the surface. That means that achieving angular match forces the ion collection device 160 to be positioned as close as possible to the orthogonal direction but not interfering with the optical beam. The collected analyte is conveyed to an optional mass analyzer 180 and/or ion detector system 182. Ion collection device 160 and sample support surface 112 are optionally at the same electrical potential. Thus, the volume between ion collection device 160 and sample support surface 112 is optionally field free. On the other hand, ion collection device 160 can be electrically biased relative to the sample plate to draw ions into the inner cone region 164 where a combination of DC and FR electric fields can be applied to provide efficient ion transfer to the mass analyzer. In some embodiments, there is little or no pressure differential between the outer cone 162 and the inner cone 164 of ion collection device 160.

Mass analyzer 180 can include any of the systems known in the art for the separation of molecules or ions as a function of there masses, mass-to-charge ratios, momentum, kinetic energies, collisional cross-sections, or the like. For example, Mass analyzer 180 may include any one or combination of mass analyzers known in the art, including quadrupole mass filters, quadrupole ion traps, time-of-flight analyzers, Fourier transform ion cyclotron resonance cells, and electrostatic traps, for example.

Ion detection system 182 can include any of the systems known in the art for the detection of ions or neutrals. For example, ion detector system 182 may include a micro-channel plate, a photomultiplier, an electron multiplier, or similar devices, as well as associated electronics and computing systems.

In some embodiments, MALDI/LDI source 100 includes a gas source 170 configured to provide a gas 172. The gas 172 is configured to facilitate the collection of analyte desorbed from MALDI/LDI sample 120 by ion collection device 160, and/or to ionize desorbed analyte. For example, in some embodiments, gas 172 includes a jet or stream of gas directed across MALDI/LDI sample 120 toward an entrance to ion collection device 160. Gas 172 can include argon, nitrogen, air, charged particles, reactive species, or the like. Optionally, this gas source 170 can be configured to pressurize the ion source region to an operating pressure in addition to guiding ions into the ion collection device 160. The combination of a substantially large orifice in the ion collection device 160 with a high pressure at the sample support 110 allows ions to be directed efficiently into the ion collection device 160, which is essential in applications such as micro tissue imaging, where only small amounts of ions are produced per shot of the radiation source 130.

In some embodiments, gas 172 includes chemical ionization reagents or electrons configured for ionizing analyte desorbed from MALDI/LDI sample 120. A wide variety of chemical ionization reagents are known in the art. Additional ionization of gas 172 may be provided by an additional laser shooting parallel to the sample support surface 112 in such a way that it activates only components already in the gas phase.

Figure 1B:
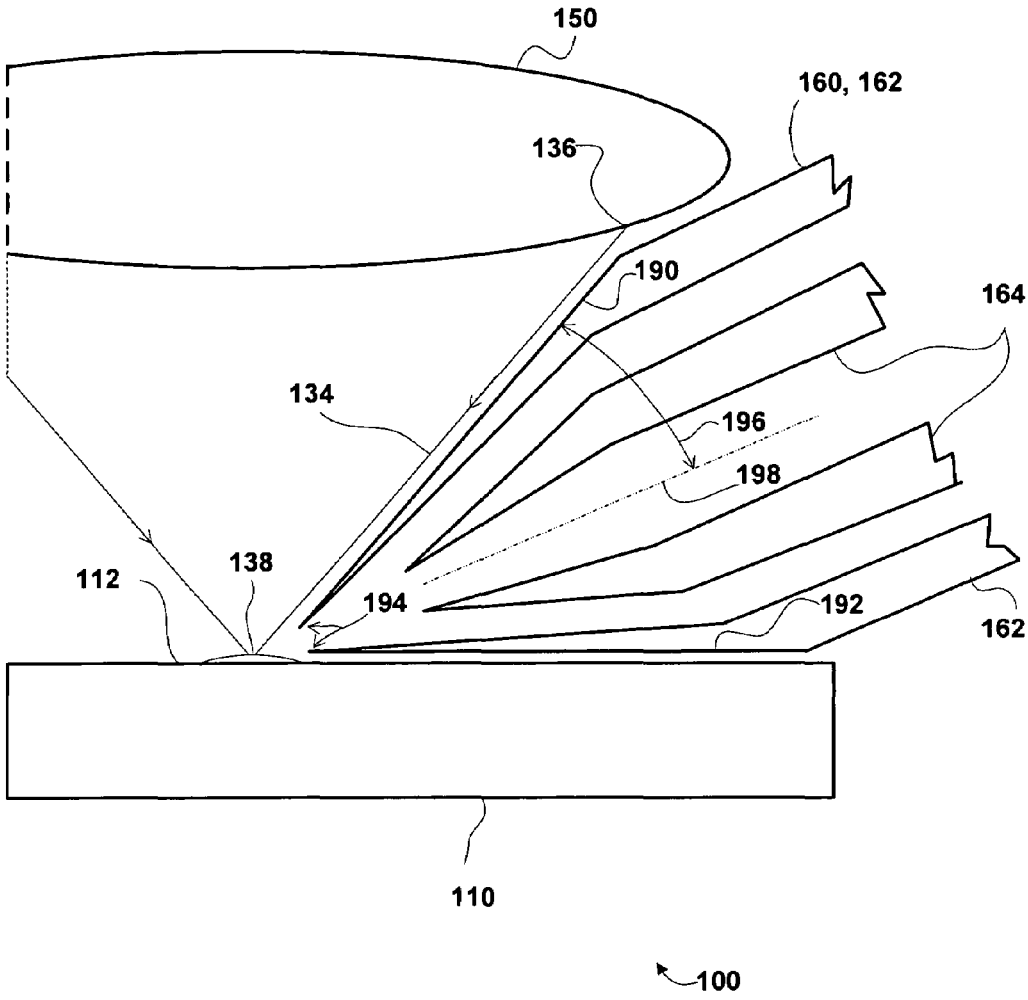

FIG. 1B illustrates further detail of MALDI/LDI source 100. A first edge 190 of outer cone 162 is approximately parallel to beam envelope 134 between first point 136 and focal point 138. In some embodiments, a second edge 192 is approximately parallel to a plane of the sample support surface 112. First edge 190 and second edge 192 terminate at an orifice 194. Orifice 194 is configured to allow analyte desorbed from MALDI/LDI sample 120 to enter (e.g., be collected by) ion collection device 160. The positioning of first edge 190 approximately parallel to beam envelope 134, and optionally of second edge 192 approximately parallel to the plane of the sample support surface 112, allows orifice 194 to be placed in a desirable position closer to focal point 138 than is possible if first edge 190 were not approximately parallel to beam envelope 134. In alternative embodiments, an angle between beam envelope 134 and first edge 190 is less than 20, 15, 10, or 5 degrees. In various embodiments, orifice 194 is disposed at a position less than 10, 8, 6, 5, 4, or 3 millimeters from focal point 138. An angle 196 from a center axis 198 of ion collection device 160 optionally characterizes first edge 190. The value of angle 196 is typically dependent on focal length 152 of beam focusing optics 150 and the dimension 132 (typically the beam width), because an angle between sample support surface 112 and beam envelope 134 is dependent on focal length 152 and the beam width 132. In other embodiments, the sample support surface 112 may be nonlinear (e.g. curved) and the second edge 192 may be positioned approximately parallel to the plane tangent to the sample support surface 112.

Figure 2:
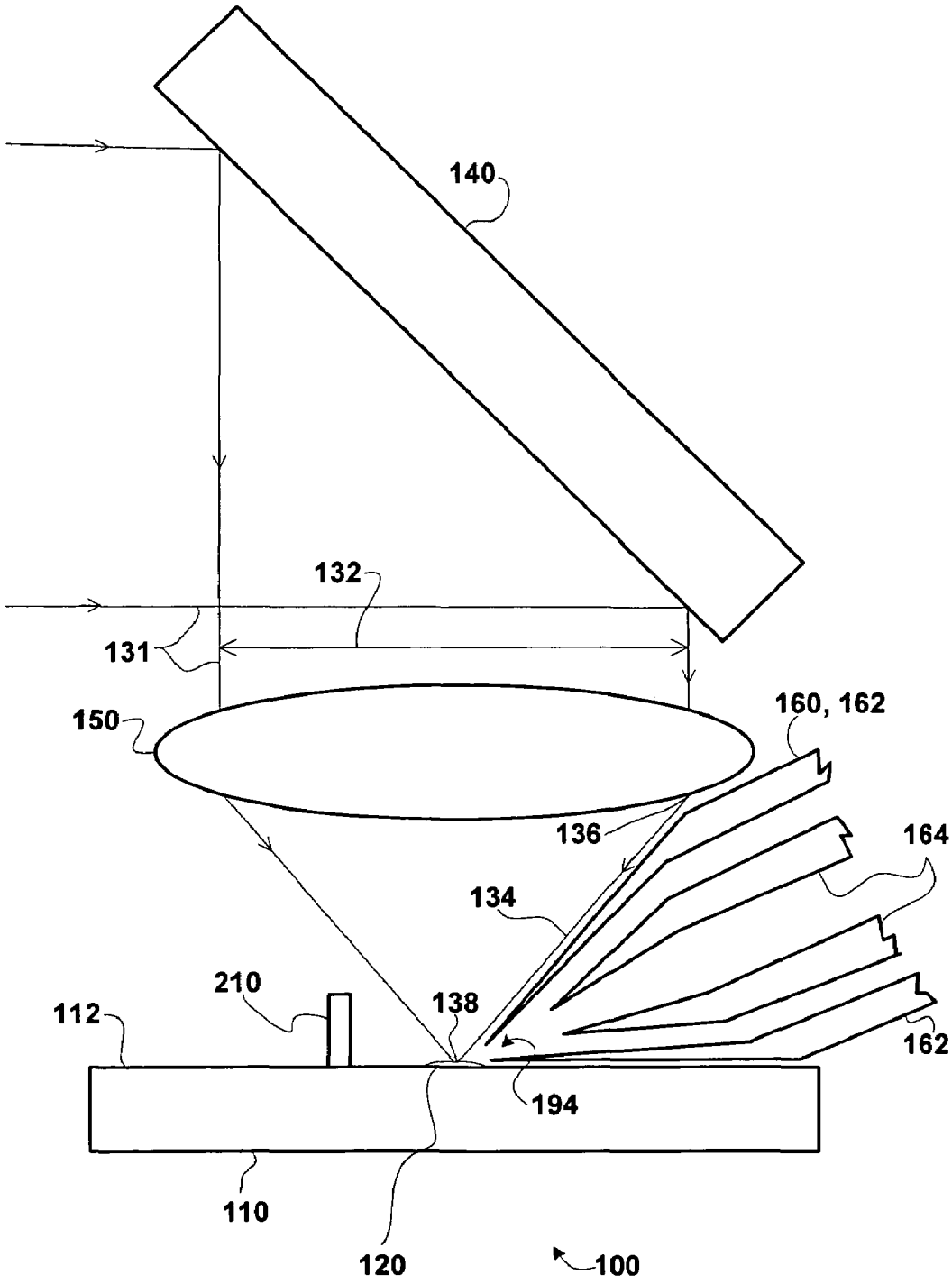
FIG. 2 is an illustration of a MALDI/LDI source including an additional electrode, according to various embodiments of the invention.

FIG. 2 is an illustration of an embodiment of MALD/LDI source 100 including an electrode 210. Electrode 210 is configured to generate an optional electric field between electrode 210 and ion collection device 160. The generated electric field is orientated to accelerate charged analyte desorbed from MALDI/LDI sample 138 toward orifice 194 and thus increase the collection efficiency of desorbed analyte. Electrode 210 can be configured in a wide variety of shapes, positions and orientations, attached to the surface or put separately For example, electrode 210 may be a tube lens placed on the opposite side to the ion collection device 160 as illustrated. Applied voltage could be constant or pulsed in sync with the laser.

Figure 3A:
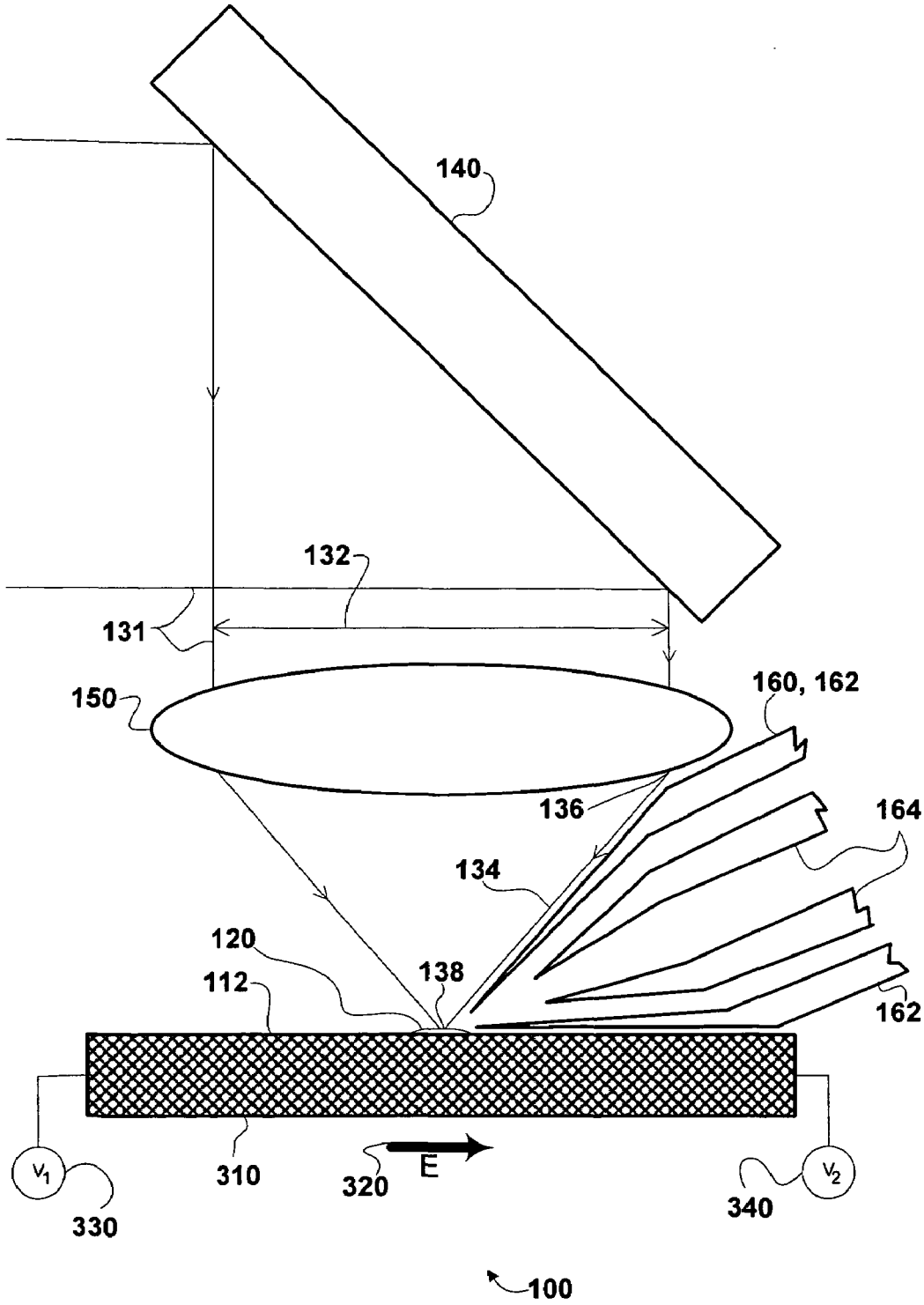
FIG. 3*a* is an illustration of a MALDI/LDI source including a resistive layer, according to various embodiments of the invention.
Figure 3B:
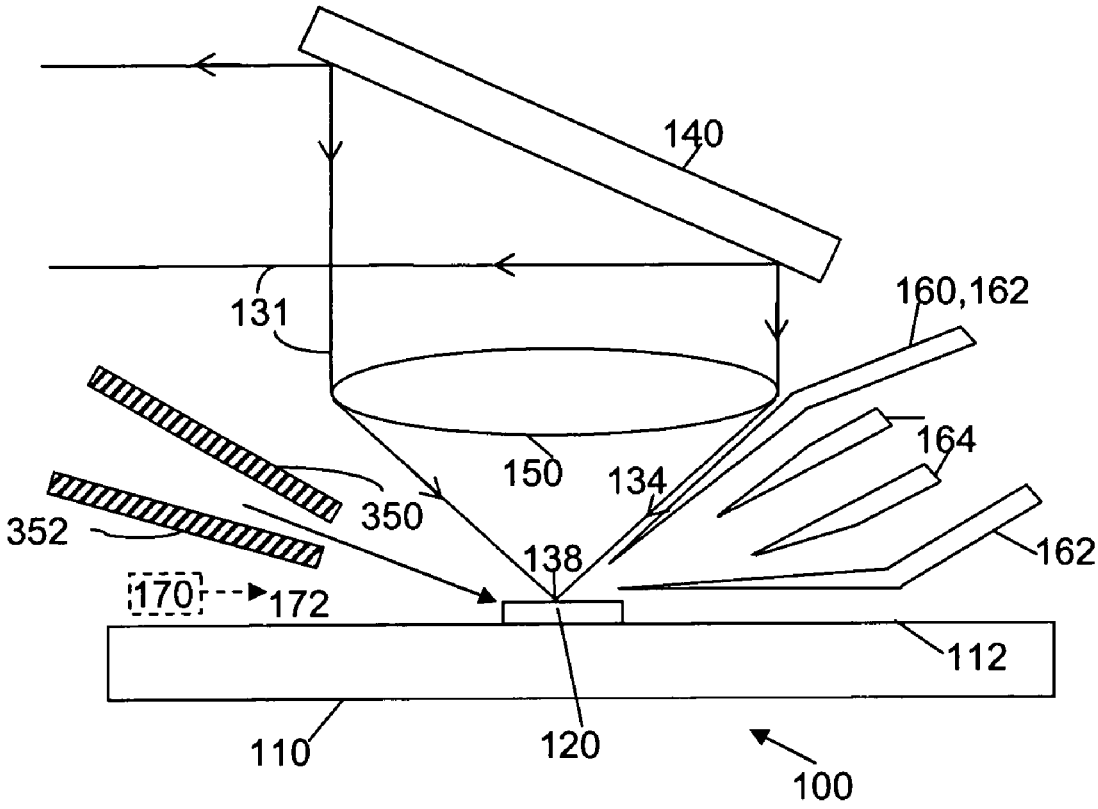
FIG. 3*b* is an illustration of a MALDI/LDI source including an external matrix source

FIG. 3*a* is an illustration of an embodiment of MALDI/LDI source 100 wherein sample support 110 (FIG. 1) includes a resistive sample support 310 configured to generate an electric field 320 in a direction facilitating ion transfer from MALDI/LDI sample 120 to ion collection device 160. Resistive sample support 310 can include a carbon composite, metal film, semiconductor, or other resistive material known in the art. Typically, electric field 320 is generated by applying a first potential 330 to one part of resistive sample support 310 and a second potential 340 to another part of resistive sample support 310. In some embodiments, the resistive sample support 310 includes a resistive coating applied to the sample plate 110. In some embodiments, MALDI/LDI source 100 includes both an electrode 210 and a resistive sample support 310. In other embodiments, the resistive sample support 310 is a slide with a resistive coating, such as slides which facilitate matrix deposition for electrospray and similar devices.

In some embodiments, ionization efficiency can be improved, for example in the ionization of tissue samples, where mass spectrometry information has to be achieved in a single shot, as after that the sample is ablated. Generally, in cell-level tissue imaging, sample is fully ablated after a single laser shot. MALDI is known to produce ions out of only small fraction of ablated material ($10^{-3}$ and lower). As such, the cost of a single laser shot is high enough to consider additional means to increase ionization efficiency. Thus the main ionization event has to take place in the dense plume of desorbing material containing both tissue with matrix desorbed. That is the place where tissue molecules first encounter matrix molecules. Efficiency of protonization in the gas phase may be far from optimum. More successful collisions resulting in proton transfer to the analyte molecules could be realized if protonized matrix molecules 350 are injected from an external source, say an AP MALDI, dragged through a capillary 352 and expanded into a 1 torr region in the geometry illustrated in FIG. 3*b*. In some embodiments, the same laser that was used to ablate the sample can be used for this purpose if it is appropriately located. After these collisions, these analyte molecules mix with a stream desorbed synchronously from the surface of tissue and directed into the ion collection device 160.

Figure 4:
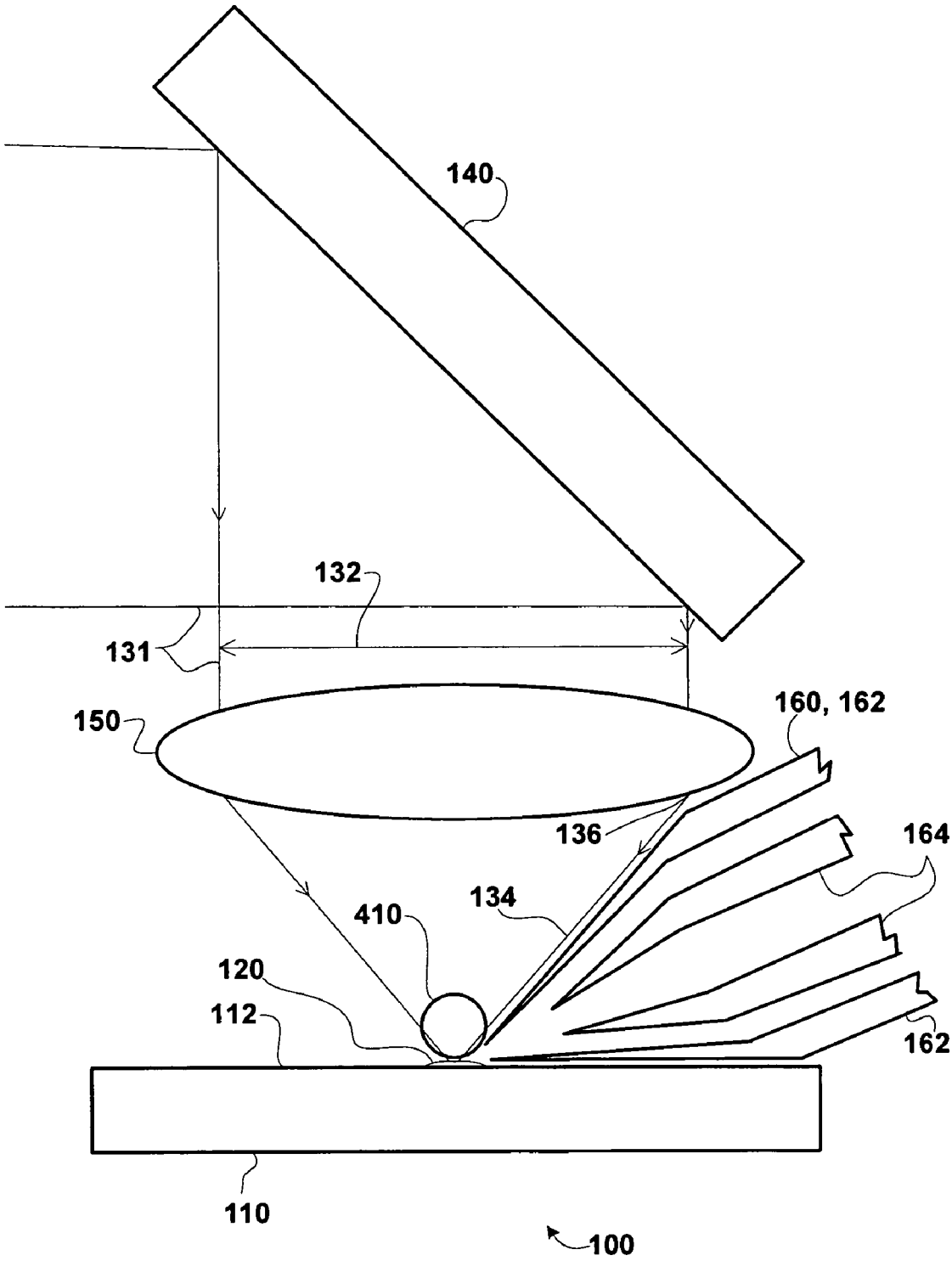
FIG. 4 is an illustration of a MALDI/LDI source including a plurality of radiation beams, according to various embodiments of the invention.

FIG. 4 is an illustration of an embodiment of MALDI/LDI source 100 including a second source of radiation 410 configured to interact with and ionize analyte desorbed from MALDI/LDI source, prior to collection by ion collection device 160. The second source of radiation 410 is optionally approximately parallel to sample support surface 112 and perpendicular to the plane of FIG. 4. Thus, in FIG. 4, the second source of radiation 410 is shown as a circular cross-section. The second source of radiation 410 can be generated by a laser, arc lamp, or the like. In alternative embodiments, the second source of radiation 410 is configured to fragment analyte ions desorbed from MALDI/LDI sample 120 or initiate photo-ionization of a chemical reagent added to a buffer gas to stimulate chemical ionization of desorbed species.

Figure 5:
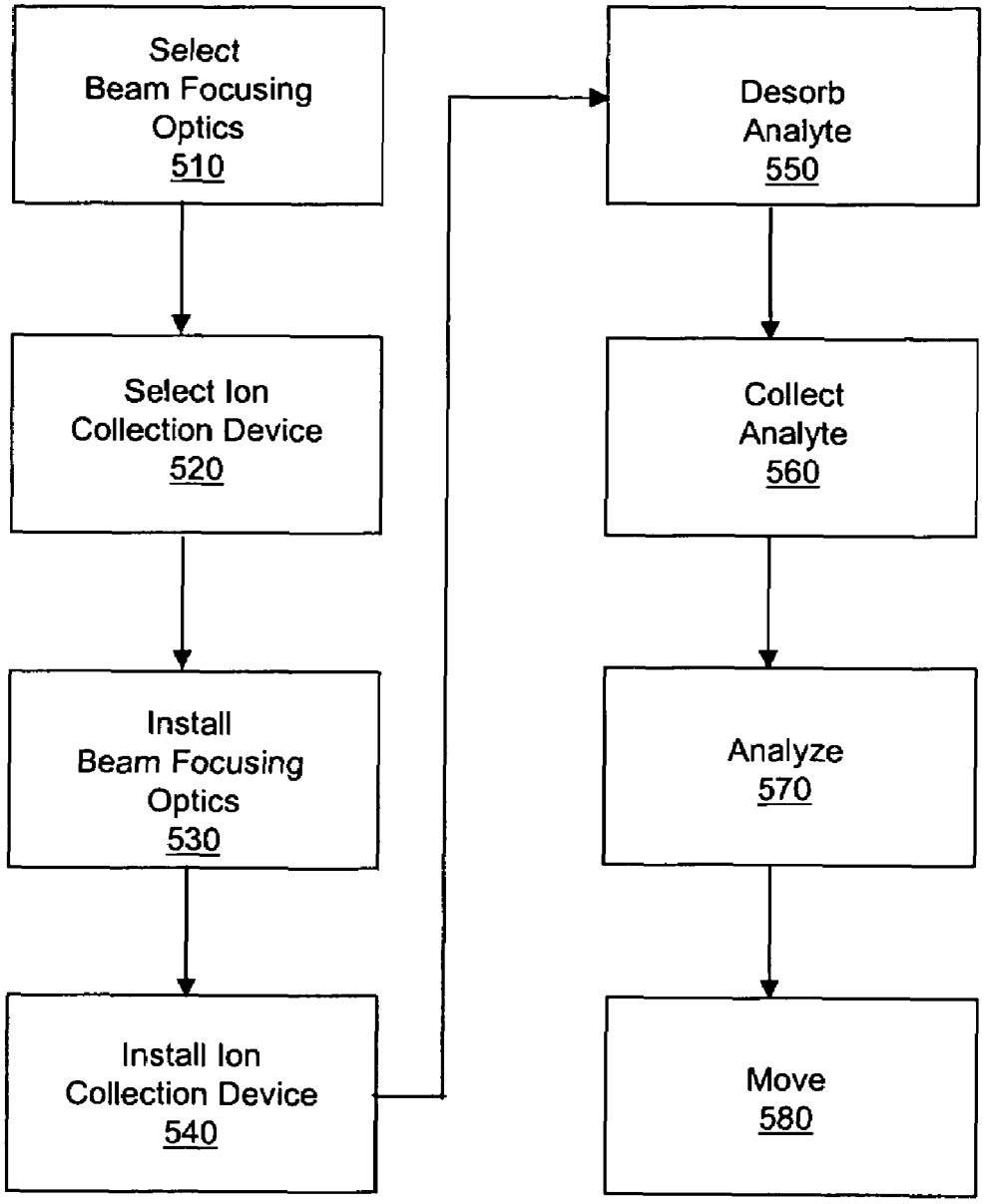
FIG. 5 is a flowchart illustrating a method, according to various embodiments of the invention.

FIG. 5 is a flowchart illustrating a method, according to various embodiments of the invention. In a Select Beam Focusing optics step 510, a user selects a desired Beam focusing optics 150 from a plurality of alternative beam focusing optics. Beam focusing optics 150 is characterized by a focal length and a numerical aperture and optionally selected based on a desired size of focal point 138. For example, in some embodiments a small focal point 138 is desirable to achieve a desired spatial resolution in the area of MALDI/LDI sample 120 desorbed. Thus, in the Select Beam Focusing Optics Step 510 an instance of beam focusing optics 150 may be selected responsive to a desired spatial resolution in analysis of MALDI/LDI sample 120. In some embodiments, a focal point 138 of a specific size is desirable to achieve a desired photon power intensity at focal point 138.

In a Select Ion Collection Device Step 520, ion collection device 160 is selected from a plurality of alternative ion collection devices, each characterized by a different angle 196. Ion collection device 160 is selected such that first edge 190 can be positioned approximately parallel to beam envelope 134, while positioning orifice 194 in a desired location relative to focal point 138. In some embodiments, each alternative beam focusing optics is associated with an alternative ion collection device. In Select Ion Collection Device Step 520, ion collection device 160 is optionally also selected such that second edge 192 is approximately parallel to sample support surface 112.

In an Install Beam Focusing Optics Step 530, the instance of beam focusing optics 150 selected in Select Beam Focusing Optics Step 510 is installed in MALDI/LDI source 100. In an Install Ion Collection Device Step 540, the instance of ion collection device 160 selected in Select Ion Collection Device Step 520 is installed in MALDI/LDI source 100.

In a Desorb Analyte Step 550, radiation source 130 is used to generate radiation 131. Radiation 131 is focused using beam focusing optics 150 to focal point 138 such that part of MALDI/LDI sample 120 is desorbed. In some embodiments, the desorption process includes ionization of some of the desorbed analyte with the laser or using chemical ionization.

In a Collect Analyte Step 560, the analyte desorbed in Desorb Analyte Step 550 is collected using ion collection device 160. Gas 172, electrode or electrodes 210, and/or resistive sample support 310 optionally facilitate the collection process.

In an optional Analyze Step 570, the collected and accumulated analyte is analyzed using mass analyzer 180 and/or ion detector system 182. This analysis can include generation of a mass spectrum and/or identification of the analyte.

In an optional Move Step 580, the relative positions of MALDI/LDI sample 120 and focal point 138 are changed such that focal point 138 is at a different part of MALDI/LDI sample 120. Desorb Analyte Step 550 is then optionally repeated. By repeating Steps 550-580, a spatial analysis of MALDI/LDI sample 120 may be performed. This spatial analysis yields data representative of the composition of MALDI/LDI Sample 120 as a function of position. For example, in some embodiments, the methods illustrated by FIG. 5 are used to analyze different parts of a biological cell.

Several embodiments are specifically illustrated and/or described herein. However, it will be appreciated that modifications and variations are covered by the above teachings and within the scope of the appended claims without departing from the spirit and intended scope thereof. For example, ion collection device 160 optionally includes mounting features configured for easy installation and replacement. In some embodiments, ion collection device 160 is integrated into sample support 110. In some embodiments, beam focusing optics 150 is replaced by an alternative focusing optics, such as a reflector.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A system comprising:

a sample support configured to support a sample on a first surface;

a first beam focusing optics configured to direct a first radiation along a beam envelope to a focal point on the sample, and having a focal length of less than 20 millimeters, the first beam focusing optics being disposed approximately parallel to the first surface; and a first ion collection device configured to collect ions generated from the sample using the directed radiation, the first ion collection device having a first outer edge approximately parallel to the beam envelope along which the first radiation is directed by the first beam focusing optics, and being disposed less than 10 millimeters from the focal point.

2. The system of claim 1, wherein the beam focusing optics has a large numerical aperture, being greater than 0.5.

3. The system of claim 2, wherein the numerical aperture is 0.8.

4. The system of claim 1, further including a gas source configured to supply a gas to transport the ions generated from the sample to the ion collection device.

5. The system of claim 1, further including an electrode configured to generate an electric field to accelerate the ions generated from the sample to the ion collection device.

6. The system of claim 1, wherein the sample support is configured to generate an electric field to accelerate the ions generated from the sample to the ion collection device.

7. The system of claim 1, further including a source of chemical ionization gas configured to ionize neutrals generated from the sample.

8. The system of claim 1, further including a second radiation configured to ionize neutrals generated from the sample.

9. The system of claim 1, wherein the first ion collection device is disposed less than 8 millimeters from the focal point.

10. The system of claim 1, wherein the first ion collection device is disposed less than 6 millimeters from the focal point.

11. The system of claim 1, wherein the first ion collection device is disposed less than 4 millimeters from the focal point.

12. The system of claim 1, wherein the first beam focusing optics has a focal length of less than 15 millimeters.

13. The system of claim 1, wherein the first beam focusing optics has a focal length of less than 10 millimeters.

14. The system of claim 1, wherein the volume between the ion collection device and the sample support are at the same electrical potential.

15. The system of claim 1, wherein the ion collection device includes a skimmer configured to maintain a pressure differential.

16. The system of claim 1, wherein the ion collection device includes an ion guide configured to guide ions between two regions of similar pressure.

17. The system of claim 1, further including a second beam focusing optics configured to be exchanged with the first beam focusing optics and having a focal length different than that of the first beam focusing optics, and a second ion collection device configured to collect ions generated from the sample and configured to be exchanged with the first ion collection device such that the second ion collection device has a first outer edge approximately parallel to a beam envelope along which the first radiation is directed by the second beam focusing optics, and being disposed less than 10 millimeters from a focal point of the second beam focusing optics.

18. The system of claim 1, wherein the first ion collection device includes a second outer edge approximately parallel to the first surface.

* * * * *